US006202369B1

(12) United States Patent
Partee et al.

(10) Patent No.: US 6,202,369 B1
(45) Date of Patent: Mar. 20, 2001

(54) UNIVERSAL ANCHOR SYSTEM

(76) Inventors: Stanley E. Partee; Mike Conner; Donnie L. Reagan, all of P.O. Box 3010, Big Spring, TX (US) 79721-3010

( * ) Notice: Subject to any disclaimer, the term of this patent is extended or adjusted under 35 U.S.C. 154(b) by 0 days.

(21) Appl. No.: 09/243,684

(22) Filed: Feb. 3, 1999

Related U.S. Application Data

(63) Continuation-in-part of application No. 08/700,873, filed on Aug. 21, 1996, now abandoned.

(51) Int. Cl.[7] ..... E02D 5/80; E02D 27/42

(52) U.S. Cl. ..... 52/165; 52/296; 52/298; 52/726.3; 52/726.4; 52/736.1; 52/736.4; 40/606; 248/523; 248/530; 285/322; 285/324; 403/371

(58) Field of Search ..... 52/156, 165, 295, 52/296, 297, 298, 726.3, 726.4, 732.3, 736.1, 736.3, 736.4, 737.4, 737.5, 738.1; 40/606, 612; 248/156, 519, 523, 530; 285/148.23, 148.25, 148.26, 322, 323, 324; 403/365, 371, 372, 109.1, 110, 377

(56) References Cited

U.S. PATENT DOCUMENTS

| | | | | |
|---|---|---|---|---|
| 186,125 | * | 1/1877 | Graham | 285/323 X |
| 443,053 | | 12/1890 | McCallum . | |
| 683,312 | * | 9/1901 | Marquardt | 285/323 X |
| 795,143 | * | 7/1905 | Von Lom | 52/296 |
| 1,155,589 | * | 10/1915 | McDonald | 248/530 X |
| 1,301,475 | | 4/1919 | Mellin . | |

(List continued on next page.)

FOREIGN PATENT DOCUMENTS

| | | | | |
|---|---|---|---|---|
| 373904 | | 1/1964 | (CH) . | |
| 571895 | | 5/1924 | (FR) . | |
| 801895 | | 8/1936 | (FR) . | |
| 1058216 | | 3/1954 | (FR) . | |
| 1169899 | * | 1/1959 | (FR) | 285/322 |
| 6866 | * | 5/1886 | (GB) | 52/298 |
| 14210 | | 7/1893 | (GB) . | |
| 29174 | | 9/1898 | (GB) . | |
| 2239 | * | 1/1903 | (GB) | 285/322 |
| 5950 | * | 7/1908 | (GB) | 285/322 |
| 16318 | | 6/1913 | (GB) . | |
| 1575295 | | 9/1980 | (GB) . | |
| 191231 | | 9/1964 | (SE) . | |

*Primary Examiner*—Laura A. Callo
(74) *Attorney, Agent, or Firm*—Richard C. Litman

(57) ABSTRACT

An anchor system for alternate types of signage includes an elongated anchor member and an attached, lowermost formation engageable with an underlying foundation to firmly support the anchor member in a substantially vertical disposition. A bore within the anchor member slidably receives the lower portion of an elongated sign pole or marker device, with a stop element within the anchor member serving to limit the length of the sign pole inserted therewithin. Secure attachment of the sign pole relative the vertical anchor member is achieved by the application of a compression element comprising a collar and having a tapered, inner surface engageable with the upper portion of the anchor member. The inclusion of a plurality of slots in the upper portion of the anchor member provides individual segments which are subsequently deflected radially inwardly upon the tightening of the compression element. Sign poles of lesser diameters may be accommodated with any one anchor member by the insertion of a split sleeve adaptor intermediate the sign pole and anchor member, while altering the height of the anchor member allows attachment of various types and sizes of signage, including signs atop the pole or barricade poles for traffic marking. Various materials may be used for the components, such as metal or nonmetallic, with the latter particularly adaptable for traffic barricades and wherein the anchor member is of minimal height.

13 Claims, 5 Drawing Sheets

U.S. PATENT DOCUMENTS

| | | | | |
|---|---|---|---|---|
| 1,890,151 | | 12/1932 | Hadley . | |
| 1,938,974 | | 12/1933 | Oldberg . | |
| 1,974,813 | | 9/1934 | Grawoig . | |
| 1,982,569 | | 11/1934 | Byrd . | |
| 2,679,911 | | 6/1954 | Bhend . | |
| 2,784,015 | | 3/1957 | Swanson . | |
| 3,020,798 | * | 2/1962 | Chrisman | 52/298 X |
| 3,066,769 | | 12/1962 | Pasquale . | |
| 3,119,588 | | 1/1964 | Keats . | |
| 3,159,248 | * | 12/1964 | Biehn | 52/165 |
| 3,335,534 | | 8/1967 | Hester et al. . | |
| 3,377,768 | | 4/1968 | Greeley . | |
| 3,381,635 | | 5/1968 | Pforr . | |
| 3,579,936 | | 5/1971 | Andersson . | |
| 3,876,320 | | 4/1975 | Phillipson . | |
| 3,952,878 | | 4/1976 | Gorham . | |
| 3,969,853 | | 7/1976 | Deike . | |
| 4,021,977 | * | 5/1977 | Deike | 52/298 |
| 4,543,757 | | 10/1985 | Cosgrove . | |
| 4,785,593 | | 11/1988 | Munoz, Jr. . | |
| 4,793,110 | | 12/1988 | Tucker . | |
| 4,802,752 | * | 2/1989 | Anglin | 285/322 X |
| 5,163,676 | | 11/1992 | Taub . | |
| 5,207,175 | | 5/1993 | Andonian . | |
| 5,337,989 | | 8/1994 | Apple . | |
| 5,540,017 | | 7/1996 | Eilam et al. . | |
| 5,571,229 | | 11/1996 | Fitzsimmons et al. . | |
| 5,649,780 | * | 7/1997 | Schall | 403/371 X |

* cited by examiner

UNIVERSAL ANCHOR SYSTEM

CROSS REFERENCE TO RELATED APPLICATION

This application is a continuation-in-part of application Ser. No. 08/700,873, filed Aug. 21, 1996, now abandoned.

BACKGROUND OF THE INVENTION

1. Field of the Invention

This invention relates generally to anchor systems and, more particularly, to an improved manner of fastening a sign post or the like in a securely supported condition relative an underlying foundation.

2. Description of the Prior Art

It is desired to provide a convenient device to facilitate the mounting of a post or standard in a stationary manner relative to an underlying foundation such as a floor, pavement or the ground. The post or standard may be associated with any of numerous devices for example, flags, signs of any type, fence posts, crowd or traffic control barricades, just to mention a few examples. The most basic technique employed to mount a post is of course to bore or otherwise excavate a hole or opening in the foundation upon which it is desired to mount a post. This procedure is obviously quite labor intensive and is usually utilized only in situations wherein the post is desired to be more or less permanently mounted in any one location. However, in many instances it is desired to only mount a particular post in a temporary situation and wherein it is expected that the post will either be removed or, another post supporting a different sign or the like will be substituted at the same location. When an excavated hole is used in cases as above, often it is necessary to bring special equipment to the scene in order to remove the existing fixed post, and then other preparations may be required when the substituted post is of a greater or lesser cross-sectional mass than the former post.

Many post mounting or attachment systems are known but few offer the adaptability and scale of economy presented by the system of the present invention. To be adaptable, a mounting system should readily accommodate posts of varying diameters as well as alternative lengths without requiring replacement of all its primary components, and should not require any special tools or skill to carry out the attachment of a post therewith. And to be economical, inexpensive components must be called for, without any intricate manufacturing steps being involved.

An early example of a post mounting system will be found in U.S. Pat. No. 1,982,569 issued Nov. 27, 1934, to Byrd, wherein a socket element disposed within the ground receives the lower end of a post, while a two-piece sleeve having a bottom flange portion respectively clampingly engaging an intermediate section of the post, and abuts the top of the buried socket element. The Byrd construction is unlike the instant system wherein a lower most pipe element is provided with an integral configuration allowing of selective radial deflection about an inserted post, upon the manipulation of a separate compression member.

U.S. Pat. No. 2,784,015 issued Mar. 5, 1957, to Swanson illustrates a pole supporting base member wherein a pole inserted within the bore of the base member is retained by means of a plurality of upper and lower wedges respectively and individually drawn together upon the tightening of bolts spanning opposed pairs of the upper and lower wedges. This arrangement is totally dissimilar to the instant construction utilizing an integral compression element operable to apply a simultaneous, inwardly clamping action upon a plurality of segments at the end of an anchor base.

Another post support will be found in U.S. Pat. No. 3,066,769 issued to Pasquale on Dec. 4, 1962, and although not directed to positive fixation between a post and the support, does depict an example of diametrically opposed wing or fin elements facilitating its use. These wing elements are permanently attached to the support, and serve in this reference as extensions of the support which may be used to drive the support axially into the ground, unlike the present invention wherein wing elements are provided on a separate compression member, and are used to permit rotation of the compression member during its application or removal.

A further example of the use of wedge elements serving to secure a post or the like within a support member is seen in U.S. Pat. No. 3,335,534 issued to Hester et al. on Aug. 15, 1967. A pair of wedge shaped segments cooperate with a fixed circular support base having a tapered socket portion cooperating with the wedge segments to clamp a post there within. This construction departs from that being taught herein and wherein a unitary compression member having a tapered interior portion is applied exteriorly of the top of an anchor base to radially deflect and bias a plurality of segments on the anchor base in clamping engagement with an inserted post.

Another example of camming means employed to secure a pole to a base will be found in U.S. Pat. No. 3,579,936 issued May 25, 1971, to Andersson. In this reference, a concrete base is formed and provided with a socket for receiving a pole which is then retained by a plurality of pairs of camming devices respectively connected together with tie rods. The instant development differs from the above considerably in that no pairs of wedge elements requiring tie rods are involved.

U.S. Pat. No. 4,793,110 issued to Tucker on Dec. 27, 1988 is directed to a building structure and its foundation. A base or socket member embedded in concrete is formed with an inclined side wall and between this wall and an inserted post or column, is disposed a wedge that is driven downwardly to obtain a secure attachment. With the present invention, no separate wedge element is driven between a post and its anchor or socket, but instead, a compression member is applied atop an anchor to produce a radial deflection of split segments on the anchor top into clamping engagement with an inserted post.

French Patent No. 571,895 dated May 26, 1924, depicts a further example of a lower, socket member provided with a bore for receiving a post or pole, and wherein retention is achieved through the use of a plurality of circumferentially spaced wedge elements which are driven into a clamping mode by the manipulation of individual nuts engaging the threads of a bolt. This is contrary to the present arrangement wherein a unitary compression collar serves to deflect a plurality of segments integral with the top of the socket or anchor member.

In French Patent No. 1,058,216 dated Mar. 15, 1954, one elongated member is disposed within a surrounding elongated member and secured thereto through the application of a plurality of wedge elements driven downwardly intermediate the two elongated members and a cooperating outer inclined portion on the surrounding member. This departs from the current system wherein a single outer most compression member provides the sole clamping action to bias the slotted top portion of an anchor member against as inserted pole.

In the case of Swedish Patent No. 191,231 dated Sep. 1, 1964, another example will be seen of a post support including a base member having a socket and within which is disposed a post that is secured through the application of a pair of surrounding wedge elements, all situated within the confines of the socket. Such construction vastly departs from the current construction which involves an outer compression ring serving to radially deflect split segments formed on the upper portion of the anchor member.

Several other references are noted for disclosures teaching signage support structure or mere joint making schemes. U.S. Pat. No. 443,053 issued Dec. 16, 1890, to McCallum, discloses a jointed lamp post. U.S. Pat. No. 1,301,475 issued Apr. 22, 1919, to Mellin, discloses an adjustable gear shift lever. U.S. Pat. No. 1,890,151 issued Dec. 6, 1932, to Hadley, discloses a muffler mounting and exhaust pipe bushing. U.S. Pat. No. 1,938,974 issued Dec. 12, 1933, to Oldberg, discloses a muffler pipe bushing. U.S. Pat. No. 1,974,813 issued Sep. 25, 1934, to Grawoig, discloses a pipe bushing for exhaust systems. U.S. Pat. No. 2,679,911 issued Jun. 1, 1954, to Bhend, discloses a television antenna supporting structure. U.S. Pat. No. 3,119,588 issued Jan. 28, 1964, to Keats, discloses a temporary sign post stand having a weighted type base. U.S. Pat. No. 3,377,765 issued Apr. 16, 1968, to Greeley, discloses a sectional pole antenna. U.S. Pat. No. 3,381,635 issued May 7, 1968, to Pforr, discloses a portable chair having a ground engaging support base. U.S. Pat. No. 3,876,320 issued Apr. 8, 1975, to Phillipson, discloses a fishing rod handle joint. U.S. Pat. No. 3,952,878 issued Apr. 27, 1976, to Gorham, discloses a collapsible gun stand. U.S. Pat. No. 3,969,853 issued Jul. 20, 1976, to Deike, discloses a finned sign post or cable anchor. U.S. Pat. No. 4,543,757 issued Oct. 1, 1985, to Cosgrove, discloses a fence post anchoring support. U.S. Pat. No. 4,785,593 issued Nov. 22, 198, to Munoz, Jr., discloses a building column support anchor. U.S. Pat. No. 5,163,676 issued Nov. 17, 1992, to Taub, discloses a portable basketball goal and stand. U.S. Pat. No. 5,207,175 issued May 4, 1993, to Andonian, discloses a spring loaded sign post structure. U.S. Pat. No. 5,337,989 issued Aug. 16, 1994, to Apple, discloses a pole stand having a pair of locking pivot arms for securing the assemblage thereof. U.S. Pat. No. 5,540,017 issued Jul. 30, 1996, to Eilam et al., discloses a telescopic flagpole. U.S. Pat. No. 5,571,229 issued Nov. 5, 1996, to Fitzsimmons et al., discloses a ground inserted support structure for poles. French patent document no. 801,895, published Aug. 20, 1936, shows a sectional antenna. British patent document no. 14,210, published Aug. 26, 1893, shows a structure for forming a joint between two tube ends of dissimilar diameter. British patent document no. 16,318, published Jun. 5, 1913, shows a sleeve for maintaining electrical continuity in conductive pipes. British patent document no. 29,174, published Sep. 10, 1898, shows a mechanism for mounting a split pulley on a shaft. British patent document no. 1,575,295, published Sep. 17, 1980, shows an anchor support with a rubber bushing for corrosion prevention. Swiss patent document no. 373,904, published Jan. 31, 1964, shows a telescopic support stand for diverse articles.

None of the above inventions and patents, taken either singly or in any combination, is seen to even remotely suggest or describe the instant invention as claimed herein.

SUMMARY OF THE INVENTION

The anchor system of this invention allows ready adaptation for the securement of poles or posts of varying diameters in numerous situations. A significant attribute is that no initially loose nuts, bolts and wedge members are involved, thereby obviating the necessity of having to handle and manipulate with a wrench in a coordinated manner, a plurality of fastener elements in order to obtain a pole that is truly axially aligned with its supporting anchor or base.

With the instant system, no excavation of the ground or foundation structure is called for as the anchor member is preferably mounted atop the underlying supporting medium, such as by a transverse base plate, which may assume a variety of peripheral configurations. Alternatively, the base plate may be omitted by forming the anchor member with a lower most drive point. The tubular anchor member includes a series of vertical slots communicating with its upper edge such that a plurality of integral segments are provided. By selecting an anchor member having an internal dimension only slightly larger than that of the intended pole or post, the securing of the pole to the anchor member is achieved through the application of a compression device having a slightly tapered and threaded inner surface. This latter device is applied to the top of the anchor member which is formed with mating threads such that upon application of the compression element, by hand or a suitable simple tool, it may be threaded in place, causing the split segments at the top of the anchor member to radially deflect inwardly. This action produces an extremely tight clamping condition, positively securing the pole in place, in true, vertical alignment with the anchor member.

Alternatively, the threads on the anchor member and compression element may be omitted, with the tapered configuration of the compression element providing a suitable clamping action when driven downwardly onto the anchor member.

It is not necessary to replace any one anchor member when it is desired to install a different pole or post having a smaller cross-sectional dimension, as a split adaptor sleeve is offered, serving to accommodate lesser dimensioned poles. With this adaptation, the adaptor sleeve, which may be provided with a stop formation at its upper end, is slipped down into the top of the anchor member prior to insertion of the pole. Thereafter, the same compression device is applied and simultaneously deflects the anchor member split segments and the intermediate split sleeve as the pole is secured upon the reduction of the inner diameter of the sleeve.

The height and mass of the supported pole often dictates the necessary length or height of the anchor member and accordingly, anchor members of varying lengths may be employed, while additionally, a transverse element may be provided through the bore or socket of the anchor member to serve as a stop defining the limit of insertion of a particular pole. In this manner, a plurality of similar poles or other elongated members may be installed with a certainty of equal pole heights throughout any one project.

The present concept is adaptable to provide barricades or the like as used in traffic marking or along median lines of roadways. During highway construction it is often desirable to have the capability of frequently erecting and changing the location of active signage or markers to safely identify and control the proper traffic lanes during the constantly changing construction procedures. In this respect, it is proposed to utilize an anchor member of minimum height, provided with upper most split segments and externally threaded to accommodate a compression element adapted to secure a pole serving as a traffic marker or barricade. Although galvanized metal is the preferred material for the system components, it will be appreciated that synthetic compositions such as plastics or synthetic rubber may be employed, especially for highway signage which is most likely to be subject to impact from moving vehicles.

Accordingly, one of the objects of the present invention is to provide an improved anchor system for poles, signs and the like and wherein an anchor member is affixed to an underlying foundation, and includes an upper end provided with a plurality of vertical slots defining peripheral segments about which a compression member is applied to clampingly secure an elongated pole element relative the anchor member.

Another object of the present invention is to provide an improved anchor system for poles, signs and the like including a base element affixed relative a supporting foundation, and having an elongated anchor member attached thereto with a compression device frictionally attached at its top to releasably clamp a pole inserted within the top of the anchor member.

A further object of the present invention is to provide an improved anchor system for poles, signs and the like including a stationary vertical anchor member having a compression device attached at its top for radially deflecting peripheral split segments into locking engagement with an inserted pole, and provided with a transverse stop element in the anchor member defining the limit of insertion of the pole therein.

Still another object of the present invention is to provide an improved anchor system for poles, signs and the like including a vertical anchor member affixed to a foundation and having a tapered compression device threadedly attached at its top, with a split sleeve disposed within the upper portion of the anchor member to accommodate an inserted pole having an outer dimension substantially less than the inner dimension of the anchor member.

These and other objects of the present invention will become readily apparent upon further review of the following specification and appended claims.

BRIEF DESCRIPTION OF THE DRAWINGS

Similar reference characters designate corresponding parts throughout the several figures of the drawings.

DETAILED DESCRIPTION OF THE PREFERRED EMBODIMENTS

Figure 1:
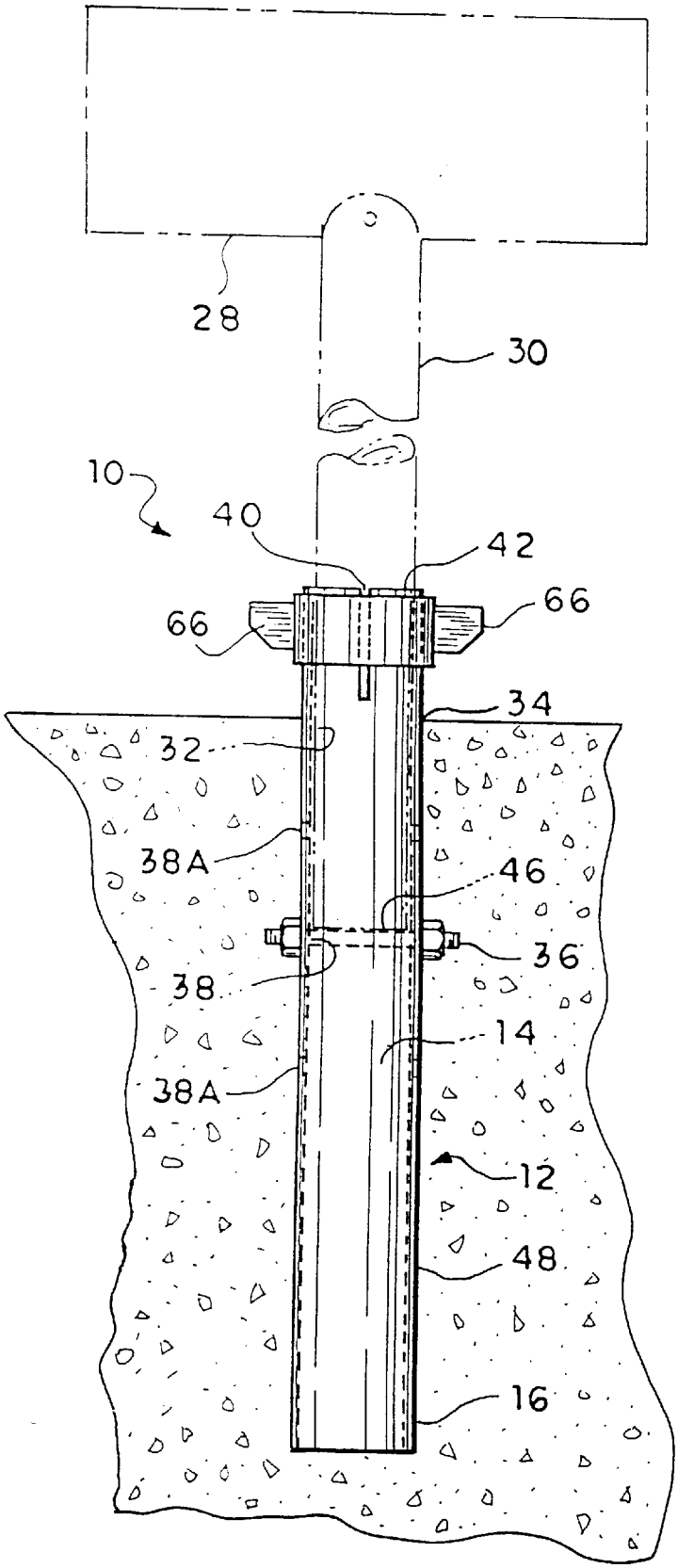
FIG. 1 is a side elevation of a first embodiment of a sign anchor assembly according to the invention.

Referring now to the drawings, the present invention will be seen to relate to an anchor system, generally designated 10 and which serves to provide ready means by which any of various types of signs or marker devices may be quickly and easily mounted or erected within different types of environments. The ease by which this signage is achieved is facilitated by employing an elongated anchor tube or member 12 having an interior bore 14, preferably throughout its length. Although a circular member 12 is favored, it will be appreciated that other cross-sectional configurations may be used such as rectangular, polygonal or the like. A square cross-section obviously would be the most appropriate configuration for accommodating wooden sign posts. Various materials may be used in the construction of the components of the current support system. Thin walled galvanized steel or anodized aluminum will be the most popular and economical although other materials may be utilized in certain circumstances as will be described hereinafter.

Figure 2:
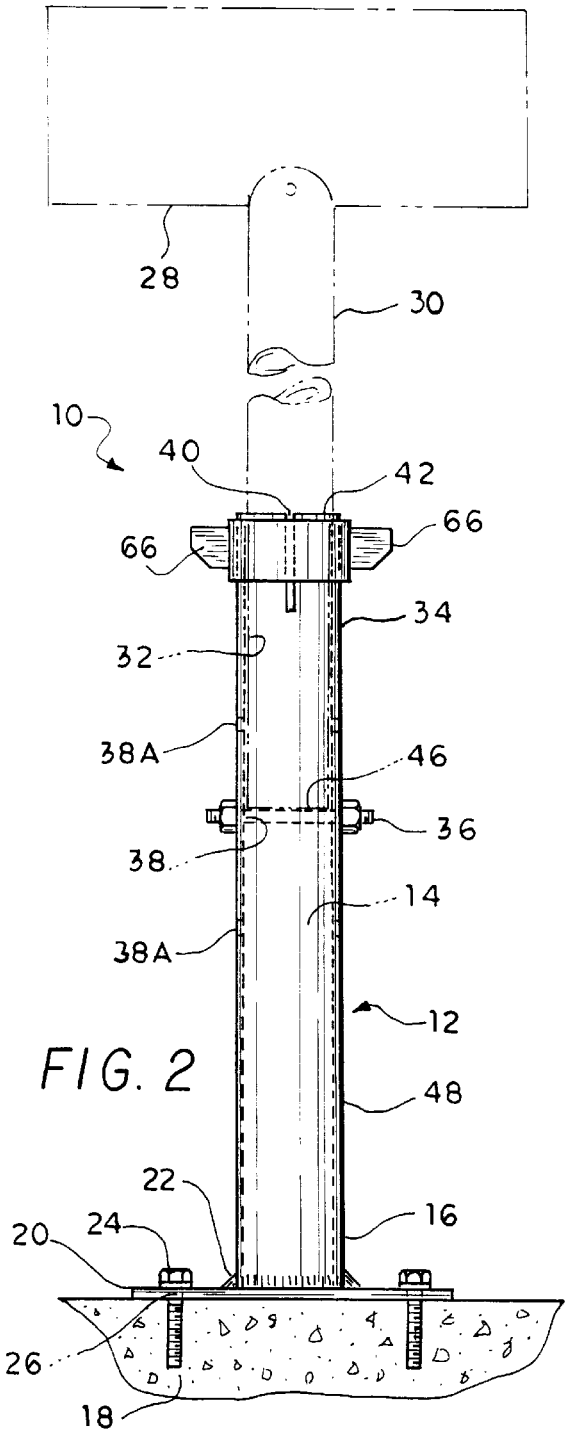
FIG. 2 is a side elevation of a second embodiment of a sign anchor assembly according to the invention.

Referring first to the second embodiment of FIG. 2, the anchor member 12 is intended to be erected with its lower portion 16 suitably mounted juxtaposed an underlying supporting foundation. When such foundation comprises a relative flat, hardened surface, such as pavement 18, erection of the anchor system 10 is most readily accomplished by use of a transverse planar base plate 20 suitable affixed to the tube lower portion 16, such as by the illustrated welding 22. The base plate 20 may define any desired peripheral configuration including rectangular, triangular or the like, and may be secured to the underlying foundation material 18 by appropriate fastener devices 24 installed through openings 26 in the base plate. Such fasteners may comprise any well known devices suitable for the concerned foundation 18, such as expansion bolts, explosively-driven fasteners, etc. Other fastener means will become apparent upon discussion of a further system embodiment later on.

An erected anchor member 12 may define various heights or lengths depending upon the nature of the signage associated therewith. For example, if a relatively lightweight sign 28 needs to be mounted at only a modest height above the foundation 18, then the height of the anchor member 12 need not be extensive. On the other hand, a heavier sign 28 intended to be supported at a height of say, ten or more feet, would necessarily require a longer or higher anchor member to insure adequate stability. In most cases, the height of the anchor member will be selected to accommodate a sign post or pole 30 inserted substantially within the upper one-third of the anchor member's bore 14, as shown in FIG. 2 between the broken lines designating the inner diameter of the wall of the anchor member 12. The diameter or cross-sectional configuration of the bore 14 is preferably selected to slidably accommodate sign poles 30 intended to be most commonly used with any one size of anchor member 12. In this manner, an inserted pole 30 will present a close fit when its lower section 32 is fitted within the anchor member bore 14 as shown in FIG. 2.

The limit of insertion of a sign pole lower section 32 into the upper portion 34 of the anchor member may be defined by including an appropriate stop element such as the transversely disposed stud assembly 36 extending through two diametrically opposed holes 38, 38 in the wall of the anchor member 12. To allow for variation of the height of the stop element 36, alternative pairs of holes 38A, 38A may be provided, as illustrated. Thus, the degree of support for any one sign pole may be determined by the location of the stop or limit element 36 and during the erection of a plurality of signs in any one project, a definite uniformity of signage height will be automatically achieved without having to measure the degree of pole insertion during the assembly of each sign pole 30.

Figure 3:
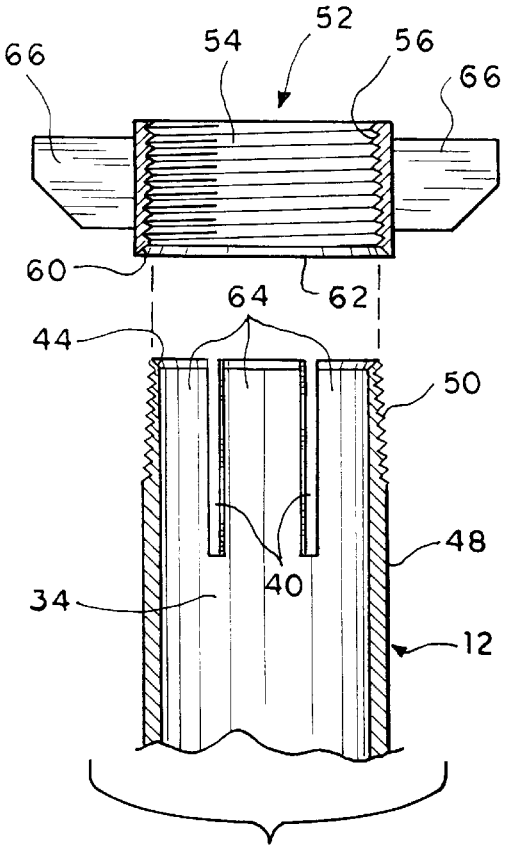
FIG. 3 is an exploded fragmentary cross-sectional view of the compression element and upper portion of the anchor member.

Another feature of the stop element 36 will be apparent when considering the subsequent application of lock means serving to firmly secure the inserted sign pole 30 in place. The upper portion 34 of the anchor member 12 will be seen to include a plurality of vertical slots or cutouts 40 extending through the top edge 42 of the anchor member. At least two but preferably four of these slots 40 are provided, equispaced from one another, while a chamfer 44 is formed on the inner peripheral surface of the top edge 42 to facilitate the insertion of the sign pole bottom edge 46. As best seen in FIG. 3, the exterior surface 48 of the anchor member 12 will be seen to include external threads 50 adjacent the top edge 42 for the accommodation of a compression element, generally designated 52 and which is constructed to cooperate with the above described thread formation on the upper portion 34 of the anchor member in order to firmly secure an inserted sign pole 30.

As can be best appreciated from FIG. 3, the compression element 52 comprises a circular collar having a slightly tapered central bore 54 adapted to engage the exterior surface 48 of the anchor member and includes internal threads 56 mating with the external threads 50 on the anchor member 12.

During assembly of the signage system, the compression element 52 is slipped about the pole 30 prior to insertion of the pole into the top of the anchor member 12. With the bottom edge 46 of the pole 30 supported upon the stop element 36, the pole and its attached sign 28 are automatically retained at the desired height without requiring any other effort on the part of the installer, thereby freeing the workman's hands for the subsequent final locking operation. The compression element 52 may include an internal chamfer 60 on its lower edge 62 to act as a guide and facilitate the lowering and engagement of the compression element 52 with the top portion 34 of the anchor member 12. As the compression element internal threads 56 engage the anchor member external threads 50, the user rotates the compression element to mate the two threads 50, 56. As the compression element is threaded upon the anchor member top portion 34, the tapered compression element threads 56 produce a radial, inwardly directed deflection of the anchor member segments 64 intermediate the slots 40. Continued tightening of the compression element 52 will be understood to cause the anchor member resilient segments 64 to be firmly urged into engagement with the sign pole 30 thus securely affixing the entire assembly relative the foundation 18. The manipulation of the compression member is enhanced by the inclusion of a pair of diametrically opposed wings or tabs 66. With this construction, a user merely grasps the two tabs 66 to rotate the compression element 52, either during application or removal of the compress element. Obviously, a suitable spanner wrench of known construction may be applied to these tabs 66 when dealing with system components of larger or heavy duty construction and in any case, these tabs 66 may serve as strike elements for any other tool, such as a hammer.

Although the compression element bore 54 is shown with the threads 56 and the anchor member with the threads 50, it will be understood that these threads may be omitted since, in many installations, the tapered bore 54 of the compression element acting on the upper portion 34 of the anchor member 12 provides a tight inward camming action when driven downwardly onto the anchor member.

With the above in mind, it will be appreciated that following the mounting of any one anchor member 12, different signs and poles 28, 30 may be erected and/or exchanged with respect to any one anchor member 12 merely by manipulating the compression element 52 to allow substitution of an alternate pole and sign, and during which, the replacement pole may be inserted within the anchor member 12 a greater or lesser amount and supported therewithin, by relocating the transverse stud limit assembly 36 through optional pairs of holes 38A.

Figure 4:
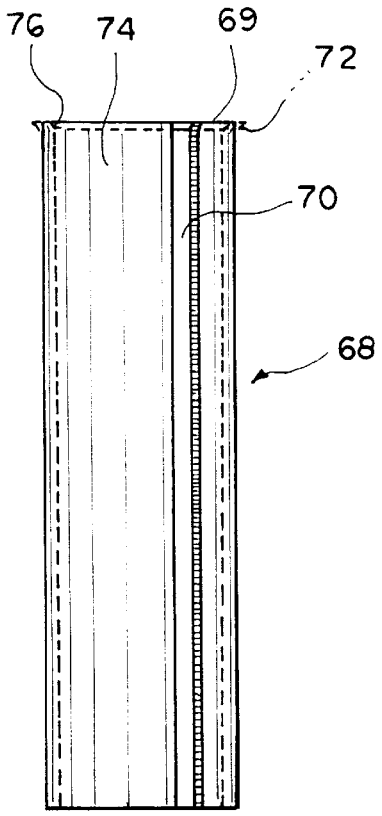
FIG. 4 is a side elevation of a split adaptor sleeve.
Figure 5:
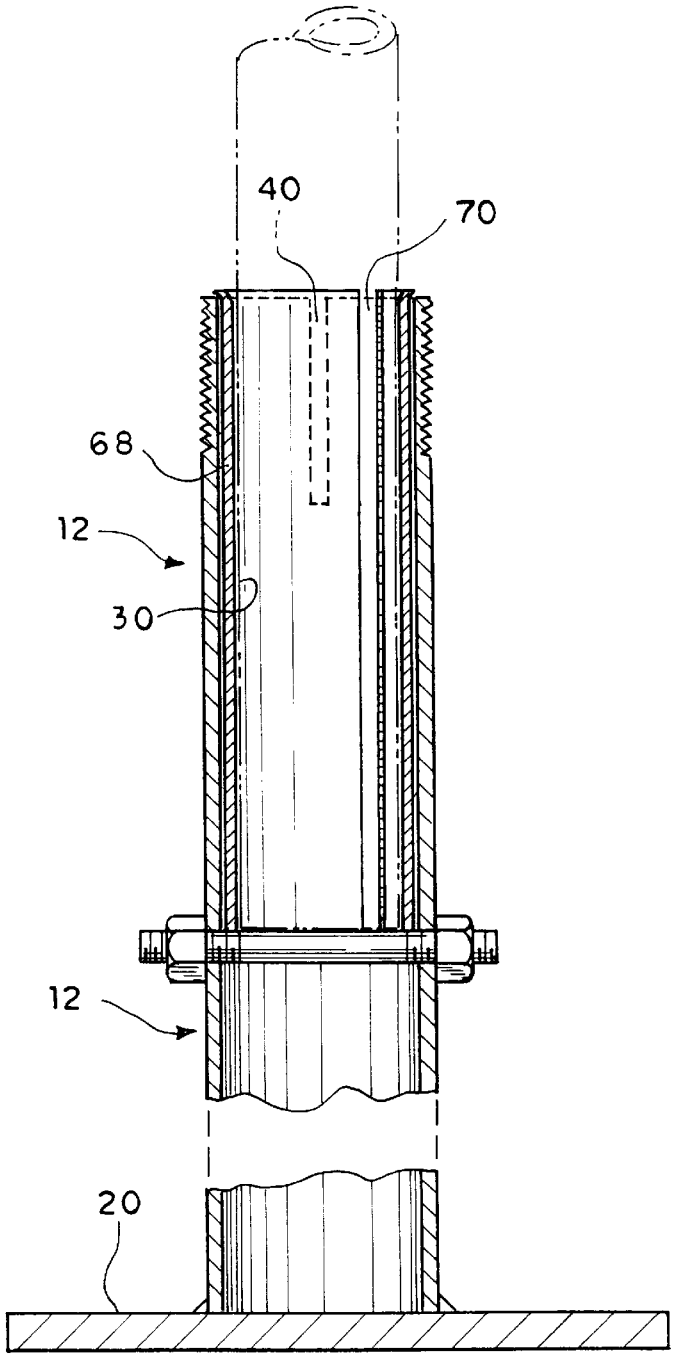
FIG. 5 is a fragmentary side elevation of the adaptor sleeve assembled within the anchor tube.

Provision is made to allow the insertion of sign poles having a smaller cross-section, into any one existing anchor member 12. This is accomplished by the use of an adaptor sleeve 68 as shown in FIGS. 4 and 5, and which comprises an elongated member having a longitudinal cutout 70. The thickness of the split sleeve 68 is selected to compensate for the reduced dimension of a lesser diameter pole 30 when inserted into an anchor member 12. Thus, its outer diameter when at rest is selected to allow a slip fit within the bore 14 of the anchor member while its inner diameter provides a close fit for an inserted sign pole 30. To retain the sleeve 68 when slipped into an anchor member 12, its length may be calculated to extend from the top edge 42 of the anchor member 12 to an installed limit assembly 36. Alternately, the top edge 69 of the split sleeve 68 may be provided with a slightly outwardly rolled lip 72 serving as a limit stop abutting the top edge 42 of the anchor member 12 when slipped into position as in FIG. 5. With this latter arrangement, the adaptor sleeve 68 need not be formed of a length designed to abut the stop assembly 36.

The final assembly of a lesser diameter sign pole when using an adaptor sleeve 68 is similar to that as above described but with the pole 30 being inserted into the bore 74 of the installed sleeve. Thereafter, upon the application of and manipulation of the compression element 52, the split segments 64 of the anchor member upper portion 34 are radially deflected inwardly and simultaneously produce a reduction in the diameter of the captive sleeve adaptor 68 as it is firmly urged into a clamping engagement with the inserted pole 30. The sleeve top edge 69 may be formed with a inner chamfer 76 to facilitate the insertion the a pole 30 into the sleeve bore 74. Additionally, the sleeve top edge 69 may include an outwardly formed lip 72 acting as an automatic stop to limit the insertion of the sleeve into the anchor member 12, in lieu of relying upon its abutment with the transverse stop assembly 36.

Figure 6:
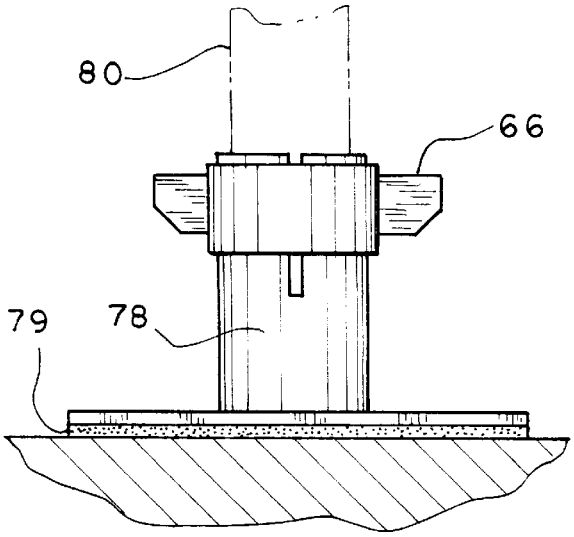
FIG. 6 is side elevation of a third embodiment as used to provide a barricade element.

The embodiment of FIG. 6 represents an alternative system useful in more than one situation and presents a noticeably shortened anchor member 78 which may be suitably affixed to an underlying foundation 18 by an appropriate base plate 20 as described in reference to the embodiment of FIG. 2. In this latter embodiment, the height of the shortened anchor member 78 is quite minimal and will be found beneficial for either installations calling for relative low signage, or for use with roadway barricades or other traffic marking signage. In such instances, the base plate 20 may be affixed as previously described or alternatively, by suitable adhesive 79, particularly in the case of barricade signage wherein the installation will often be of a temporary nature and the supported elements are of quite nominal height and mass.

In the above respect it will be appreciated that alternative materials may be considered for the construction of the various components of the system. Synthetic plastics and rubber compounds have been known as convenient materials for use as traffic barricades and markers, such as along or adjacent highway medians, particularly in view of the lesser chance of damage to any vehicles should they strike the signage. Accordingly, any or all of the components of the system, particularly as shown in FIG. 6, may be constructed of such non-metallic materials and their assembly will be understood to be the same as with respect to the previously described embodiments. Thus, the upper portion of the shortened anchor member 78 will be formed to accommodate a compression element 52 to secure either a pole 30 containing a sign 28 thereatop or, a barricade marker tube 80. Obviously, either a sign pole or barricade tube may be treated with a highly visible composition such as reflective paint.

Referring now to the first embodiment of FIG. 1, the anchor member 12 is shown as is expected to be most used in practice and therefore intended to be the preferred embodiment. As can be easily observed, each of the previously described elements of FIG. 2 are provided, but for the transverse planar base plate 20, fasteners 24, and welding 22, unnecessary for securing the anchor member when embedded during conventional construction processes. The anchor member 12 is erected with substantially all of the anchor member 12 embedded in a substantially solid ground material, such as pavement 18, concrete or the like, having its lower portion 16 entirely embedded and its upper portion 34 extending above the surface of the ground material to expose all of the slots 40 and compression element 52. Again, in most cases, the height of the anchor member will be selected to accommodate a sign post or pole 30 inserted substantially within the upper one-third of the anchor member's bore 14. The degree of support for any one sign pole may be determined by the location of the stop or limit element 36 and during the erection of a plurality of signs in any one project. Thus, when embedding the anchor member 12 to uniform level as suggested to be just below the slots 40, a definite uniformity of signage height and security will be automatically achieved without having to measure the degree of pole insertion during the assembly of each sign pole 30.

Figure 7:
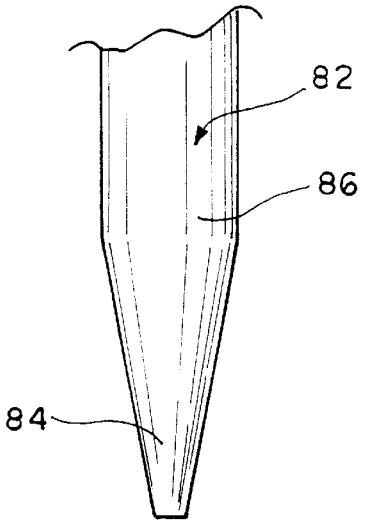
FIG. 7 is a partial side elevation of an alternative anchor tube adapted to be driven into the foundation structure.

When the underlying foundation comprises earth, the use of a horizontal base plate 20 to support an anchor member will also not prove feasible. In these instances, an anchor member 82 as shown in FIG. 7 will provide ready means for the support of a signage pole 30. The anchor member 82 will be seen to include a lower most drive point 84. The tapered or conical configuration of the point 82 permits the driving of the anchor member 84 into the earth until the lower portion 86 of the anchor member is embedded a sufficient amount to firmly maintain an attached pole and sign in a stationary vertical position.

Figure 8:
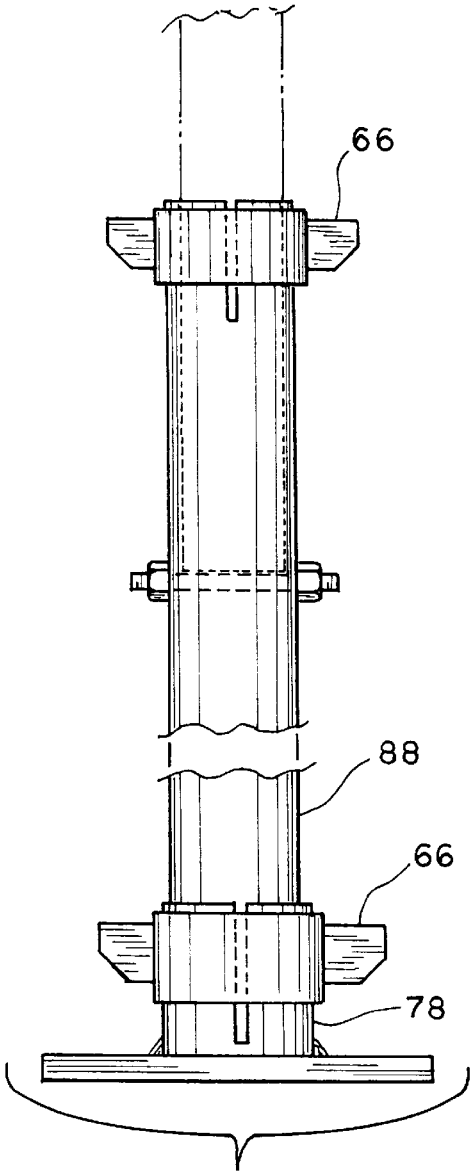
FIG. 8 is a side elevation of a modification employing two compression elements and an intermediate anchor tube.

In the modification of FIG. 8, a shortened anchor member 12 as used in the embodiment of FIG. 6 is shown, but instead of directly supporting a sign pole 30, an anchor tube 88 is affixed to the anchor member 12 by one of the compression elements 52. The anchor member 12 may be of any desired height according to the length or mass of the separate anchor tube 88 and intended signage and in this instance the anchor member 12 serves as the stabilizing formation for the anchor tube 88. The uppermost anchor tube likewise may be of any desired height, and preferably includes at least one pair of holes 38A, 38A to receive a transverse limit or stop assembly 36. The sign pole 30 is secured in the same manner as described hereabove, through the use of one of the compression elements 52.

Figure 9:
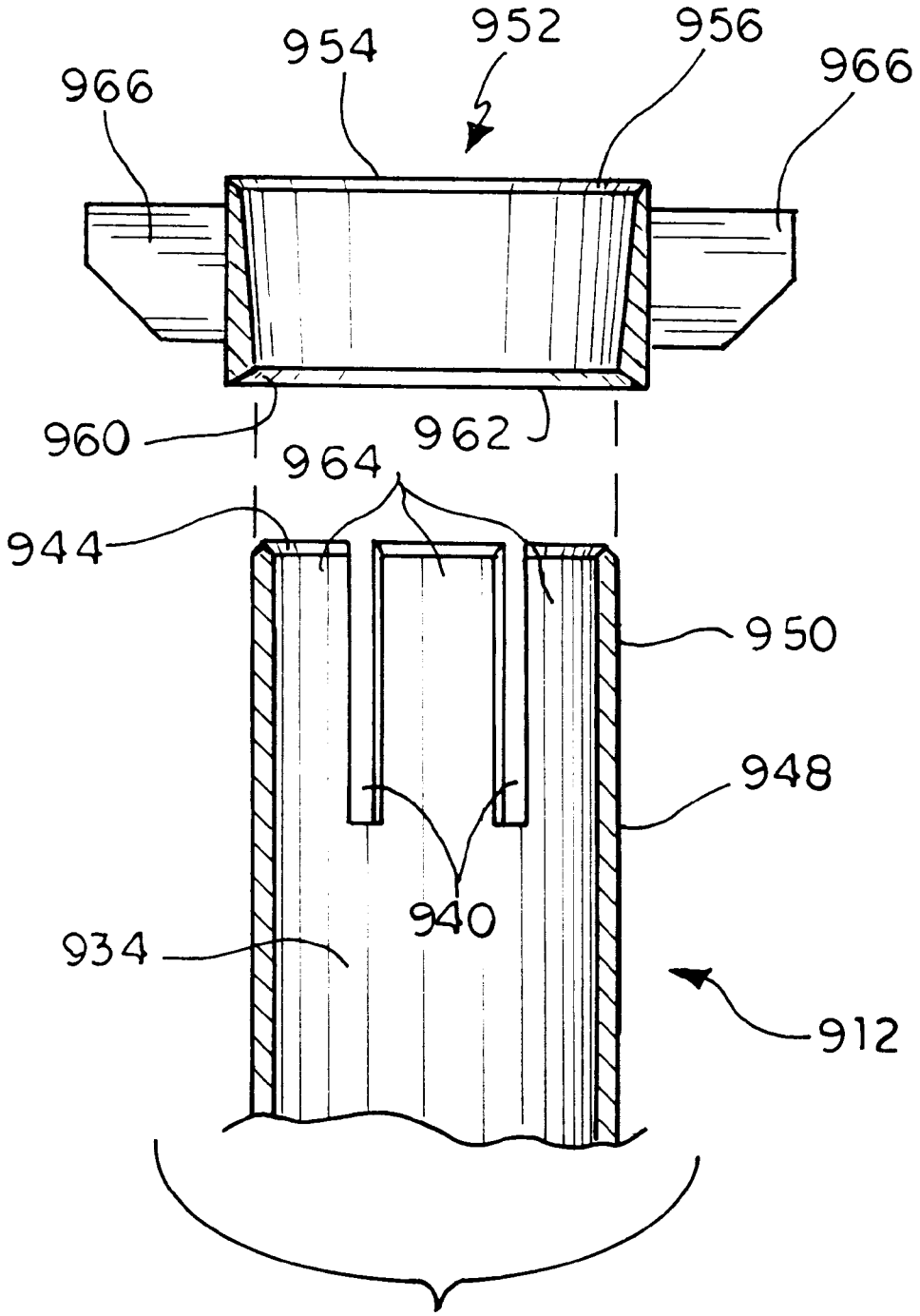
FIG. 9 is an exploded fragmentary cross-sectional view of the compression element and upper portion of the anchor member according to another preferred embodiment of the invention.

In an alternative embodiment, FIG. 9 provides the anchoring system without the need for fabricating extensive thread patterns on the compression element 52, on the inner surface of the collar 54 of FIG. 3. In FIG. 9, the compression element 952 has a circular collar having a slightly tapered central bore 954 adapted to engage the exterior surface 948 of the anchor member and includes internal tapered surface 956 mating with the external flat compression surface 950 on the anchor member 912. The upper portion 934 of the anchor member 912 will be seen to include a plurality of vertical slots or cutouts 940 forming deflectable members 962 at the top edge of the anchor member 912. At least two but preferably four of these slots 940 are provided, equispaced from one another, while a chamfer 944 is formed on the top edge to facilitate the insertion of the sign pole bottom edge 46 and compression element 952.

During assembly of the signage system, the compression element 952 is slipped about the pole 30 prior to insertion of the pole into the top of the anchor member 912. With the bottom edge 46 of the pole 30 supported upon the stop element 36, the pole and its attached sign 28 are automatically retained at the desired height without requiring any other effort on the part of the installer, thereby freeing the workman's hands for the subsequent final locking operation. The compression element 952 may include an internal chamfer 960 on its lower edge 962 to act as a guide and facilitate the lowering and engagement of the compression element 952 with the top portion 934 of the anchor member 912. As the compression element internal tapered surface 956 engages the anchor member external flat compression surface 950, the user impacts (with a hammer, for example) the compression element to mate the two surfaces 950, 956. As the compression element is impacted upon the anchor member top portion 934, the compression element surface 956 produces a radial, inwardly directed deflection of the anchor member segments 964 intermediate the slots 940. Continued tightening of the compression element 952 will be understood to cause the anchor member resilient segments 964 to be firmly urged into engagement with the sign pole 30 thus securely affixing the entire assembly relative the foundation 18. The manipulation of the compression member is enhanced by the inclusion of a pair of diametrically opposed wings or tabs 966. With this construction, a user merely impacts the tops of the two tabs 966 to press the compression element 952, during application or impacts the sides of the two tabs 966 during removal of the compression element. The internal tapered surface 956 of the compression element 952 has a varying diameter. The diameter is slightly less than the outer diameter of the anchor member 948 about the bottom of the element 952. The varying diameter increases to slightly greater than the outer diameter of the anchor member 948 at the top of the element 952. The diameter varies along the tapered surface 956. Obviously, a suitable spanner wrench of known construction may be applied to these tabs 966 when dealing with system components of larger or heavy duty construction. For example, the spanner wrench may be placed about tabs 966, serving as the impact or strike point for a hammer, or other like tool.

The embodiment of FIG. 9, may also utilize an adaptor sleeve as shown in FIGS. 4 and 5, above. In a like manner, the sleeve 68, which may be of metal, plastic, or any other suitable material, is inserted into the top portion of the anchor member 948, forming a smaller diameter receptor for signs posts. The sleeve 68 is compressed about the smaller diameter sign post 30 by the compression element 952 like the threaded version in FIG. 5.

From the foregoing it will be appreciated that an improved pole or signage anchor system is presented accommodating various sizes and types of supported signage.

It will be appreciated that the present invention is not limited to the embodiments described hereinabove, but encompasses any and all embodiments within the scope of the appended claims.

We claim:

1. An anchor system for signage comprising:

an elongated sign post having a bottom edge;

an elongated anchor member provided with an interior bore adapted to receive said sign post and having opposite upper and lower portions;

said lower portion being provided with a stabilizing formation adapted to secure said anchor member in a substantially vertical disposition relative a foundation;

said upper portion including deflectable resilient segments;

a stop element disposed within said anchor member interior bore between said upper and lower portions defining an abutment engageable by said sign post bottom edge; and a compression element engageable with said resilient segments, and operable to radially and inwardly compress said resilient segments about said sign post when inserted within said anchor member bore to fixedly secure said sign post relative said anchor member;

wherein said compression element includes a collar having a smooth internal taper which tapers from a larger diameter near the top of the compression element to a smaller diameter near the bottom of the compression element, said anchor member upper portion is provided with a smooth external flat mating surface for engaging said smooth internal taper of said collar, said compression element collar includes a lower edge having an inwardly directed chamfer, and said anchor member upper portion having a chamfer formed on a top edge of each said deflectable resilient segments.

2. An anchor system for signage according to claim 1, wherein said stabilizing formation comprises a horizontally disposed base plate secured to said anchor member lower portion.

3. An anchor system for signage according to claim 1, wherein said stabilizing formation comprises a tapered drive point.

4. An anchor system for signage according to claim 1, further including;

a top edge on said anchor member upper portion; and a plurality of substantially vertically arranged slots through said anchor member upper portion communicating with said top edge; whereby said segments are each defined intermediately of adjacent pairs of said plurality of slots.

5. An anchor system for signage according to claim 1, wherein said compression element collar includes a varying tapered internal surface diameter.

6. An anchor system for signage according to claim 1, wherein said compression element collar includes outwardly projecting wings to facilitate manipulation of said collar about said anchor member upper portion.

7. An anchor system for signage according to claim 1, including:

an adaptor sleeve having an external dimension presenting a close mating fit within said anchor member bore and insertable within said bore of said anchor member upper portion; and said adaptor sleeve having an internal dimension presenting a close mating fit with said post when inserted within said adaptor sleeve;

whereby a smaller dimensioned post may be inserted within said anchor member bore and be securely supported thereby when said adaptor sleeve is inserted within said anchor member upper portion.

8. An anchor system for signage according to claim 7, wherein said adaptor sleeve includes a linear continuous longitudinal slot throughout its extent, whereby a split adaptor sleeve is formed.

9. An anchor system for signage according to claim 7, further including:

a top edge on said anchor member upper portion;

a top edge on said adaptor sleeve; and an outwardly rolled lip on said adaptor sleeve top edge engageable with said anchor member upper portion top edge when said adaptor sleeve is fully inserted within said anchor member bore.

10. An anchor system for signage according to claim 1, wherein said anchor member and compression element are constructed of metal.

11. An anchor system for signage according to claim 1, wherein said anchor member and compression element are constructed of synthetic material.

12. An anchor system for signage according to claim 1, wherein said sign post comprises a cylindrical tube defining a roadway barricade.

13. An anchor system for signage according to claim 1, wherein said anchor member includes a pair of diametrically opposed holes intermediate said upper and lower portions, and said stop element includes an elongated member extending between said pair of holes.

* * * * *